US011761680B2

(12) United States Patent
Ferreira Da Silva et al.

(10) Patent No.: US 11,761,680 B2
(45) Date of Patent: Sep. 19, 2023

(54) EQUIPMENT FOR LASER HEATING OF FLUIDS FOR INJECTION IN WELLS

(71) Applicant: PETROLEO BRASILEIRO S.A.—PETROBRAS, Rio de Janeiro (BR)

(72) Inventors: Mario Germino Ferreira Da Silva, Rio de Janeiro (BR); Francisca Ferreira Do Rosario, Rio de Janeiro (BR); Bruno Barbosa Castro, Rio de Janeiro (BR)

(73) Assignee: PETROLEO BRASILEIRO S.A.—PETROBRAS, Rio de Janeiro (BR)

( * ) Notice: Subject to any disclaimer, the term of this patent is extended or adjusted under 35 U.S.C. 154(b) by 0 days.

(21) Appl. No.: 17/469,267

(22) Filed: Sep. 8, 2021

(65) Prior Publication Data

US 2022/0082301 A1 Mar. 17, 2022

(30) Foreign Application Priority Data

Sep. 11, 2020 (BR) ..... 1020200186370

(51) Int. Cl.
*F24H 9/20* (2022.01)

(52) U.S. Cl.
CPC ..... *F24H 9/2014* (2013.01); *F24H 2250/00* (2013.01)

(58) Field of Classification Search
CPC ..... F24H 9/2014; F24H 2250/00; E21B 43/24
See application file for complete search history.

(56) References Cited

U.S. PATENT DOCUMENTS 3,993,135 A * 11/1976 Sperry ..... E21B 43/24 166/57
4,492,093 A * 1/1985 Schwarz ..... F24H 1/208 237/2 B
4,730,673 A * 3/1988 Bradley ..... C09K 8/528 166/272.3

(Continued)

FOREIGN PATENT DOCUMENTS

BR 10706597-3 A2 1/2007
BR 102013019601-0 A2 10/2015
WO 2007/082006 A2 7/2007

*Primary Examiner* — Steven S Anderson, II
(74) *Attorney, Agent, or Firm* — RAPHAEL BELLUM PLLC

(57) ABSTRACT

The object of the invention is to solve the problem of casing and string collapse of production or injection wells, which occurs due to cooling caused by injection of completion fluids into the well, by applying heat to the fluid being injected during operations, such as acid treatments, secondary recovery, scale removal, and inhibiting squeeze.

The fluid laser heating equipment was designed to perform the heating of the fluid to be injected into a production or injection well. Before being pumped into the well, the fluid passes through the heating equipment, through a metal coil-shaped tube immersed in hot water, placed inside a tank, a laser system heats the water inside the tank, the water inside the tank exchanges heat with the coil heating the same, and in turn the coil exchanges heat with the fluid passing within it. In this way, the fluid will be at an appropriate temperature for injection into the well.

5 Claims, 2 Drawing Sheets

(56) References Cited

U.S. PATENT DOCUMENTS

| | | | | |
|---|---|---|---|---|
| 5,000,262 | A * | 3/1991 | Danzik | C09K 8/594<br>166/309 |
| 6,880,646 | B2 | 4/2005 | Batarseh | |
| 6,955,221 | B2 | 10/2005 | Bursaux | |
| 9,366,455 | B1 * | 6/2016 | Conemac | F24H 9/0021 |
| 2004/0139930 | A1 * | 7/2004 | Frasure | F24H 9/0042<br>122/367.4 |
| 2015/0219363 | A1 * | 8/2015 | Bridegum | F28D 20/0039<br>137/15.05 |
| 2021/0247104 | A1 * | 8/2021 | Moufti | F24H 1/0018 |

* cited by examiner

EQUIPMENT FOR LASER HEATING OF FLUIDS FOR INJECTION IN WELLS

FIELD OF THE INVENTION

The present invention relates to the field of oil-well, fluid-injection activities, e.g., injection of acid treatments in order to enhance well productivity, injection of water in order to pressurize the reservoir, injection of scale-removal treatments into the well production columns and/or into the reservoir, and squeeze injection of scale-inhibition treatments into the reservoir.

The laser-heating equipment applied in fluids for injection in wells can be used in an integral fashion in areas, where the need for fluid heating is required due to the possibility of collapse. Column and casing collapse may occur due to cooling during the fluid-injection operation

DESCRIPTION OF THE PRIOR ART

Fluid injection activities in oil wells are done to support specific processes, including injection of acid treatments in order to enhance well productivity, injection of water in order to pressurize the reservoir, injection of scale-removal treatments in the production columns of the wells and/or the reservoir, and squeeze injection treatments of scale inhibitors in the reservoir.

The risks and difficulties associated with the various fluid-injection operations are related to the heat exchange of the fluids injected in the well, which occurs during the pumping and displacement of fluids through the completion riser during operations carried out with a rig, and through the production line in operations carried out by the production units (petroleum exploration units, PEU).

During the displacement of fluids by the (completion or production) riser, heat exchange occurs between the fluid and the riser and/or the production or injection line immersed in the water. On the seabed at water depths of more than 700 m, the temperature of the seawater reaches as high as 5° C. The heat exchange causes the fluid inside the risers and/or production lines to cool. When the cold fluid reaches the production column, the column cools, which causes cooling of the fluid situated in the annular space between the column and the casing. Cooling of the annular space makes it collapse, followed by the collapse of the production column. Such collapses of the casing and column result in the loss of the well, be it an injection or production well.

What motivated the present invention are these integrity failures occurring in oil wells, due to the collapse of the casing and the well columns, caused thus by cooling due to fluids injected through the production columns of these wells.

As an example, the investigation of the failure mode in a well prompted us to revisit the criteria for the casing design employed by PETROBRAS through the reconstruction of its "as built" casing. Using current formulations was unable to explain the cascading collapse that resulted in the loss of integrity of the intermediate and production casing of the well.

Modified thermal analyses, not provided for by existing procedures, and of a novel nature in the industry, were performed thereby identifying time-variable safety factors, the cause of which would be due to the transient effect characteristic of the radial heat flow. Besides this effect, we evaluated the increase in pressure per annulus trapped due to the closure of plastic formations, the increase of which is time-dependent. As a result of this investigation, new casing dimensioning criteria were proposed and implemented for PETROBRAS.

Yet, in May of 2017, a failure of the HFIV (Hydraulic Formation Isolation Valve) was detected in the respective well. While investigating the failure, an annulus leakage test was performed, which revealed that the annulus was in communication with the liner shoe. This allowed for the conclusion that both the production coating and the intermediate coating had lost their hydraulic integrity.

Moreover, during the investigative process, out-of-roundness of the production column (PC) was determined with a caliper tool utilized with a Production Logging Tool (PLT). Given the high resistances of the production column (PC) to collapsing, we surmised a cascading failure of the intermediate and production casing causing the collapse and, consequently, out-of-roundness of the production column. This failure was associated with the cooling of the annuli due to the acidifying operation to which the well was subjected. However, thermal simulations of the cooling of the annuli, which was reproduced by the pumping program, did not indicate any failure upon completion of the operation.

Thus, the behavior of the collapse load in the transient state was examined by data binning the operational fluid-injection times every thirty minutes. In addition to this effect, the results of increased pressure per trapped annulus, resulting from the salt formation closure, were linked.

Determining the safety-factor (SF) curve for the intermediate casing of the well at the most critical point of the column, we found values below 1.0, i.e., the minimum value required by N-2752.

The well integrity failure caused an alert about the consequences of well-injection operations and, initially, some guidelines were established for carrying out simulations of already built wells and applying load lines for new projects. These load lines were intended to be applicable for the dimensioning of intermediate casings in "cold" wells, i.e., they were not in production.

It is worth noting that the annulus cooling simulations are highly sensitive to the fluid injection program and are not envisioned in the design phase, due to the difficulty of establishing the flow and temperature of the injected fluids, in addition to the temperature of the fluid present in the annulus at the time of confinement due to the pack-off settlement, top-of-the-cement depth, the duration of the injection operation, etc.

Due to the great difficulties of establishing a modeling of this nature, we made sure the load lines were defined. The philosophy behind these lines is that they represent the physical phenomenon of the thermal transient in a more conservative way, i.e., covering the various injection operations that can be carried out during the well's life cycle. In addition, the application of these lines is easy to put into operation, i.e., not requiring a great effort by the project teams.

The object of the invention is to solve the problem of casing and column collapse of a production and injection well by applying heat to the injectable fluid in order to prevent cooling of the production and/or injection column.

The equipment for laser heating of fluids intended for injection in wells, i.e., the object of the present invention, was designed in order to perform heating of the fluid for injection in a well, whether it be an injection or production well. According to the invention, the fluid, before being pumped into the well, passes through said equipment via a coil-shaped metal tube immersed in hot water, which is located inside a tank. A laser system will heat the water inside the tank, which exchanges heat with the coil, thereby heating the fluid passing through it. Thus, the fluid will be at a temperature, which is suitable for injection into the well.

Document U.S. Pat. No. 6,955,221B2 discloses a method for actively heating hydrocarbon liquids contained in a pipe flow line in a hydrocarbon conveying pipe, the annulus of which contains thermal insulation material and/or a partial vacuum for high insulation performance, wherein the method comprises the step of passing hot liquid along the annulus, in which the hot liquid is preferably water. Although the document describes the heating of a fluid to be pumped into the well, it does not provide details regarding the heater, nor does it cite the use of electromagnetic radiation.

Document BRPI0706597A2 discloses an apparatus and a method for increasing and regulating the temperature, pressure, and viscosity of fluid flows encountered in oil and gas production. The apparatus regulates the temperature of fluids, by means of and via an improved heating apparatus, which may be placed at one or more locations along a well-surface pipe, or a seabed pipe. Despite heating the fluid injected into the well, regulating and realizing temperature sensing and measurement of the lifting system, the document uses an electric heater, in contrast to the invention, which uses electromagnetic radiation emanating from the laser.

Document U.S. Pat. No. 6,880,646B2 discloses an application of laser-derived energy in order to initiate or promote the flow of, e.g., oil from a production well. This document provides a method and apparatus for reducing the viscosity of highly viscous fluids in order to increase the flow of fluids contained in rock formations in the vicinity of a well. Despite using a laser to generate heat, assisting in reducing fluid viscosity or mitigating scales, the work differs from the object of the present invention, besides not having a heating tank with coils, in which the fluid is heated by the system and injected into the well, as is the case in the present invention.

Document BR102013019601-0A2 discloses an integrated water-production and injection-flow system in oil reservoirs with a water-heating subsystem for injection into oil reservoirs. The system utilizes the heat gone to waste in the turbogenerators that feed a Petroleum Exploration Unit (PEU) in order to heat the water that ensures the flow of the produced fluid. Despite disclosing a system, in which fluid is heated and subsequently injected into the well in order to improve the oil recovery factor, the document does not cite the use of laser-heat generation, as does the present invention.

The above-cited prior art does not contain the unique features, which will be presented in detail below.

BRIEF DESCRIPTION OF THE INVENTION

The present invention aims to solve the problem of casing and column collapse by applying heat to the fluid to be injected in an injection or production well in order to prevent cooling of the production and/or injection column, which causes the casing and column to collapse.

The equipment for laser heating of fluids proposed by this invention is meant to perform heating of the fluid to be injected into a production or injection well.

In the embodiment of this invention, the fluid, before being pumped into the well, passes through the heating equipment through a coil-shaped metal tube immersed in hot water, positioned inside a tank. A laser system heats the water inside the tank. The water inside the tank exchanges heat with the coil, and this in turn causes heat to be exchanged with the fluid passing through it. This means that the fluid will be at a temperature, which is suitable for injection into the well.

BRIEF DESCRIPTION OF THE DRAWINGS

The present invention will be described in more detail below with reference to the attached drawings, which, in a schematic manner and not limiting the inventive scope, represent examples of its reduction to practice. In the drawings.

DETAILED DESCRIPTION OF THE INVENTION

Figure 1:
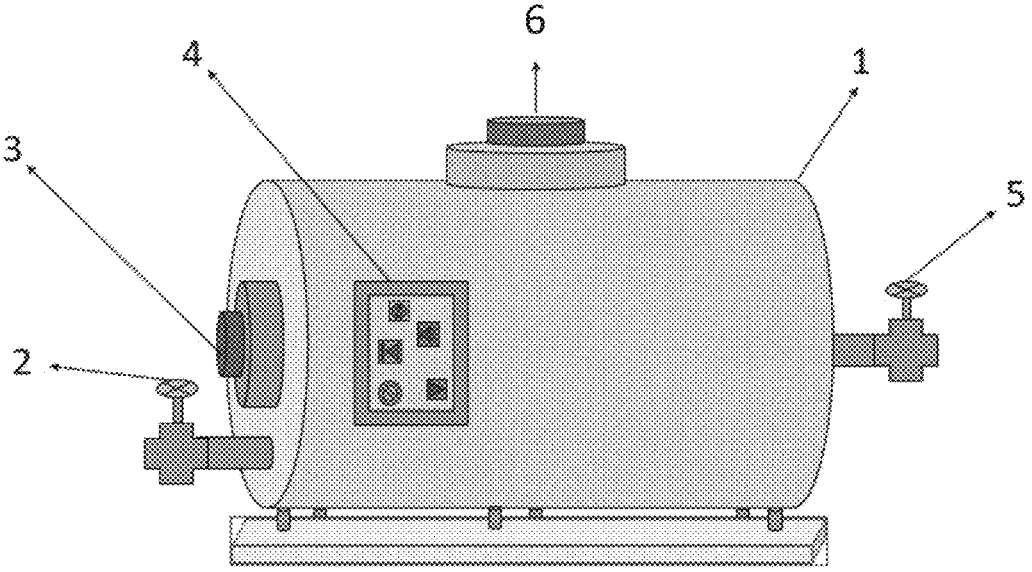
FIG. 1 is an external view of the tank of the laser-fluid heating equipment, showing: a tank (1), a valve for accessing the front external manifold (2), a heating system with a laser source (3), a control panel (4), a valve accessing the rear (5) external manifold, cover for accessing the tank (6).
Figure 2:
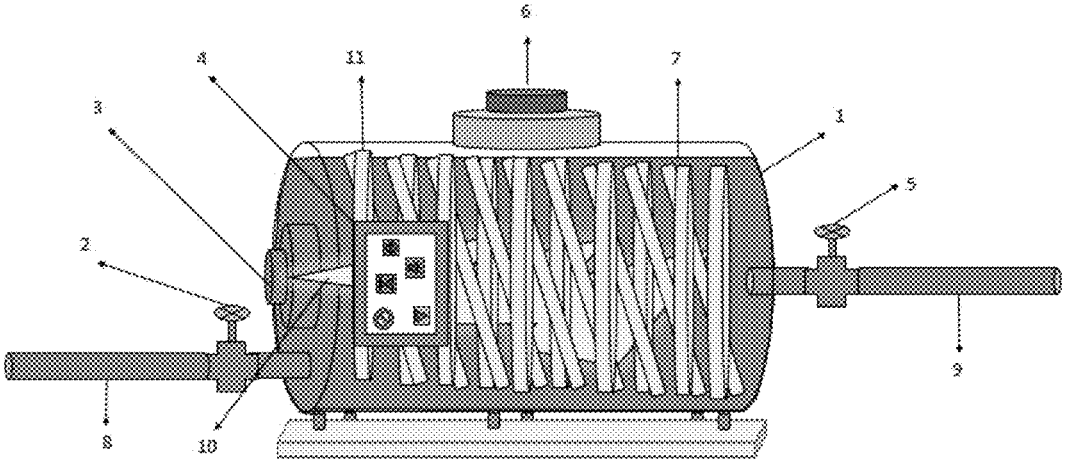
FIG. 2 is an internal view of the tank of the equipment for laser heating of fluids, which shows: a tank (1), a valve for accessing the front external manifold (2), a heating system with a laser source (3), a control panel (4), a valve for accessing the rear external manifold (5), a cover for accessing the tank (6), a water level inside the tank (7), an inlet line to the fluid tank to be heated (8), an outlet line from the heated fluid tank (9), laser radiation designed inside the tank (10), a coil (11).

The equipment for laser heating of fluids for injection in wells, as shown in FIGS. 1 and 2, consists of a tank (1) with an internal heat-exchange system, wherein the heating is generated by utilizing laser radiation (3).

Figure 3:
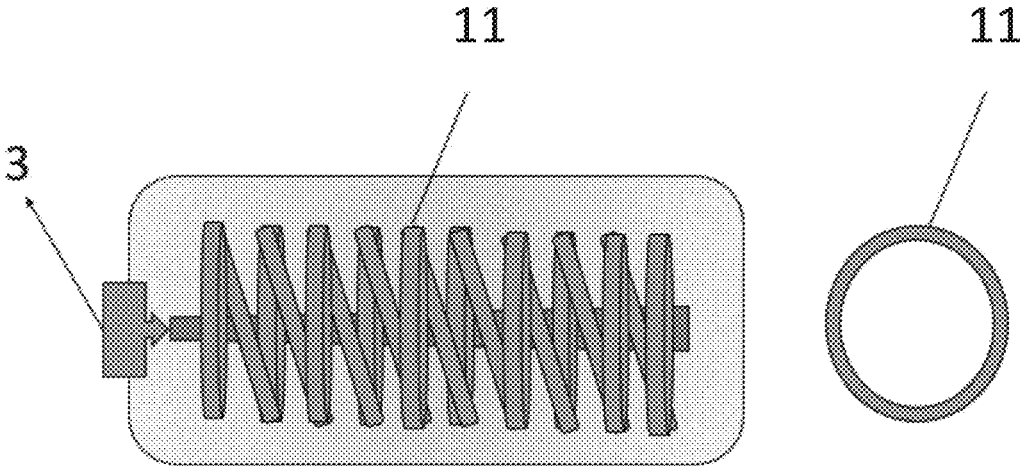
FIG. 3 shows the coil for exchanging heat with the activated laser system, representing a heating system with a laser source (3) and a coil (11).

The equipment consists of a tank (1) with an inlet line for the fluid to be heated (8), connected to the external front part of the tank, a valve for accessing the front external manifold (2), an internal system of spiral-shaped lines (11) immersed in water, a heating system powered by a laser source (3), centered relative to the spiral-shaped lines (11), as shown in FIG. 3.

The entire tank (1) is filled with water. On the outer rear of the tank is a heated fluid outlet line (9) for connecting the lines, which are routed to the well, in addition to the valve for accessing the rear external manifold (5). The heat-exchange control within the tank system (1) is performed by the control panel (4), which has a monitoring system installed and coupled to the tank for programming and controlling the heat exchange by means of the laser (3) application, temperature control, adjustment and measurement of the fluid flow.

The fluid to be heated is introduced into the tank (1) through the inlet line (8), and passes through the access valve of the front external manifold (2), where the fluid supply lines or hoses are attached. After passing through the inlet line (8), the fluid enters the tank (1) through the spiral line (11) and traverses the whole length of the spiral line (11). During the passage of the fluid, it is heated by the water contained in the tank (1) at a higher temperature. The heated fluid then passes through the outlet line (9) in order to be aligned in the direction of the well system.

The laser (3) is applied to the water contained in the tank (1) via the interior of the spiral lines (11) in order to improve the efficiency of the heat exchange. A control panel (4) is installed on the outside of the tank (1) in order to control the heating operation.

A software monitor is used for monitoring the heating operation inside the tank, and its purpose is to regulate and measure the heat exchanges inside the tank. The heated fluid inside the tank proceeds through the system lines of the rig or the petroleum exploration unit PEU, then passes through the interior of the completion or production riser, then passes through the interior of the production and/or gas injection lines, through the manifold submarine, the well's production line, at the wet Christmas tree at the well's production column and reaches the reservoir. The control panel's monitoring system is intended to be regulated, such that it calculates the thermal balance of heat exchanges in the production system in order to prevent the temperature of the injected fluid from dropping into a range, which would cause the collapse of the casing, as well as the injection or production column of the well.

The invention claimed is:

1. A system for laser heating of fluids comprising:

a tank capable of holding a first fluid, a valve coupled with a front external pipe, a laser configured to heat the first fluid, a control panel in communication with the laser, a valve coupled with a rear external pipe, a cover for accessing the tank, an inlet line coupled with the valve coupled with the front external pipe, an outlet line coupled with the valve coupled with the rear external pipe, and an internal system having spiral-shaped lines, wherein a second fluid flows from the inlet line to the outlet line through the spiral-shaped lines, and wherein the laser is applied to the first fluid via an interior of the spiral-shaped lines.

2. The system for laser heating of fluids according to claim 1, wherein the spiral-shaped lines are submerged in the first fluid inside the tank.

3. The system for laser heating of fluids according to claim 1, wherein the laser heating system includes a laser source.

4. The system for laser heating of fluids according to claim 3, wherein the laser heating system is situated at the center of the spiral-shaped lines.

5. The system for laser heating of fluids according to claim 1, wherein control of heat exchange inside the tank system is performed by the control panel provided with the supervisory system.

* * * * *